United States Patent [19]

Jankovsky et al.

[11] 4,403,634

[45] Sep. 13, 1983

[54] WEFT YARN STORAGE DEVICE FOR WEAVING MACHINES

[75] Inventors: Frantisek Jankovsky, Winterthur; Paul Lincke, Zell, both of Switzerland

[73] Assignee: Sulzer Brothers Limited, Winterthur, Switzerland

[21] Appl. No.: 244,834

[22] Filed: Mar. 17, 1981

[30] Foreign Application Priority Data

Apr. 1, 1980 [CH] Switzerland ..... 2555/80
Jan. 7, 1981 [CH] Switzerland ..... 60/81

[51] Int. Cl.[3] ..... D03D 47/36

[52] U.S. Cl. ..... 139/452; 242/47.01; 242/47.08

[58] Field of Search ..... 139/452, 450, 435; 66/132 R, 132 T; 242/47.01, 47.12, 47.08

[56] References Cited

U.S. PATENT DOCUMENTS 2,662,556 12/1953 Svaty ..... 139/452 X
3,325,073 6/1967 Biler et al. ..... 139/452 X
3,938,561 2/1976 Scheffer ..... 139/435
4,043,361 8/1977 Scheffer ..... 139/452
4,132,368 1/1979 Schiess et al. ..... 139/452 X

FOREIGN PATENT DOCUMENTS 48-27218 8/1973 Japan ..... 139/452
909406 10/1962 United Kingdom ..... 139/452
1042868 9/1966 United Kingdom ..... 139/452
397572 2/1974 U.S.S.R. .

*Primary Examiner*—James Kee Chi
*Attorney, Agent, or Firm*—Kenyon & Kenyon

[57] ABSTRACT

The weft yarn storage device has a yarn advancer (15) having a yarn guide in the form of a hollow cylinder (14) which deposits the weft yarn (10) in the form of a loop having two parallel arms (28, 29) on a respective drum (1, 4). To pick the weft yarn an electromagnet (8) is energized, armature (7) thereof disengaging the drums (1, 4) from one another so that the loop (27) released from the drums (1, 4) can be picked by the rotating picking drum (17) and by the picking nozzle (19). The weft yarns storage device makes it possible for weft yarn storage times to be other than 180°.

9 Claims, 6 Drawing Figures

Fig.3
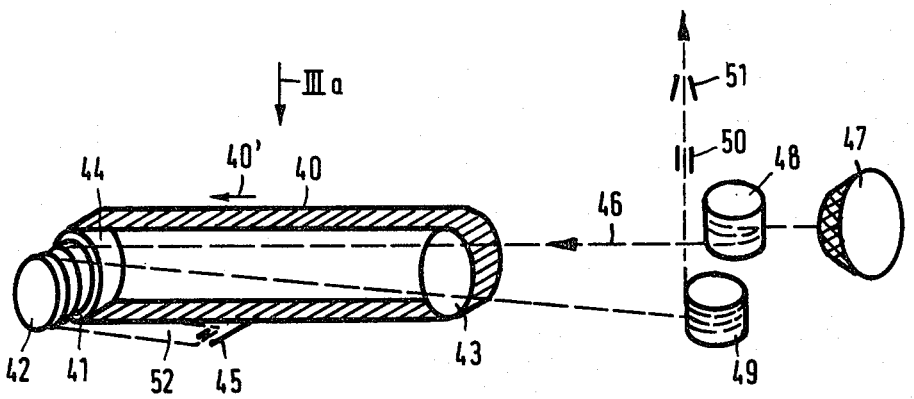
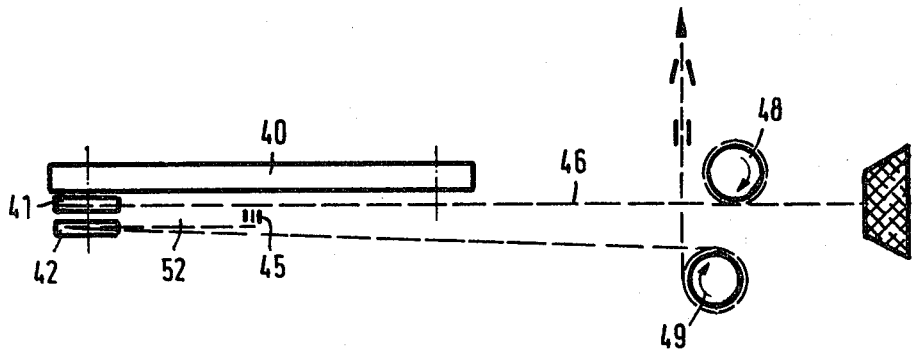
Fig.3a

WEFT YARN STORAGE DEVICE FOR WEAVING MACHINES

The invention relates to a weft yarn storage device for weaving machines. More particularly, this invention relates to a weft yarn storage device having a yarn advancer having a yarn guide for storing the weft yarn in the form of a loop.

The known device (German Offenlegungsschrift No. 2 177 705) of this kind has the disadvantage that the time required to store the weft yarn corresponds to only 180° of one revolution of the machine main shaft. The time for picking is therefore 180°. However, it is desirable to have a shorter picking time in some cases since the dwell time of the reed with the yarn-conveying nozzles in the shed can be correspondingly shorter. This state of affairs facilitates the movement pattern for beating-up.

It is the object of the invention to provide a weft storage device of the kind outlined which gives a storage time of more than 180°.

Briefly, the invention provides a weft yarn storage device for a weaving machine which is comprised of at least one curved yarn carrier a yarn advancer having a yarn guide for depositing a loop of yarn on at least a part of an outer periphery of the yarn carrier, and actuating means for releasing the yarn loop from the carrier for removal from storage.

In one embodiment, the yarn carrier includes a pair of storage drums while the yarn guide is disposed for rotation about the drums to lay one arm of a yarn loop on one drum and another arm of the yarn loop on the other drum. In this embodiment, one of the drums is not rotatable and coaxially movable while the other drum and the yarn advancer are both rotatable in the same direction. In this case, the actuating means is connected to the movable drum in order to separate the drums from each other for release of the yarn loop during a picking operation. Alternatively, the yarn advancer can be connected to the actuating means so as to be moved coaxially of the drums in order to release the yarn loop.

The yarn advancer may be in the form of a rotatable crank so that the yarn guide rotates about the yarn carrier. Alternatively, the yarn advancer may be in the form of an endless belt with a yarn guide movable about the yarn carrier.

In the case where the yarn advancer is in the form of an endless belt, the belt may be disposed about guide rolls and arranged in a triangular array. In this case, the yarn carrier may be formed by a pair of drums which are movable coaxially relative to each other so as to permit a loop of yarn to pass therebetween during a picking operation. Alternatively, the yarn carrier may be in the form of a pair of rollers each having a V-shaped recess. Further, the actuating means may be in the form of a pivot arm on which the rollers are mounted and which is pivotal from a yarn holding position into a yarn release position during a picking operation relative to the triangular array of the endless belt.

It still another embodiment, the yarn carrier may be in the form of a rotatable drum while the yarn advancer is in the form of a rotatable bent tube which is coaxial of the drum. In this case, the bent tube deposits the yarn on the drum to form at least one loop. In addition, the actuating means may be in the form of an electromagnet having an armature which is movable from a yarn holding position adjacent to the drum for holding the yarn on the drum periphery into a yarn release position in order to release the yarn loop from the drum periphery. This drum may also be provided with a helical groove and may also be of conical shape within the grooved area to accommodate a plurality of yarn loops.

These and other objects and advantages of the invention will become more apparent from the following detailed description taken in conjunction with the accompanying drawings wherein:

FIG. 1 shows a weft storage device in accordance with the invention;

FIG. 1*a* is a plan view looking in the direction of an arrow Ia in FIG. 1;

FIG. 3 shows another embodiment of a weft yarn storage device;

Figure 4:
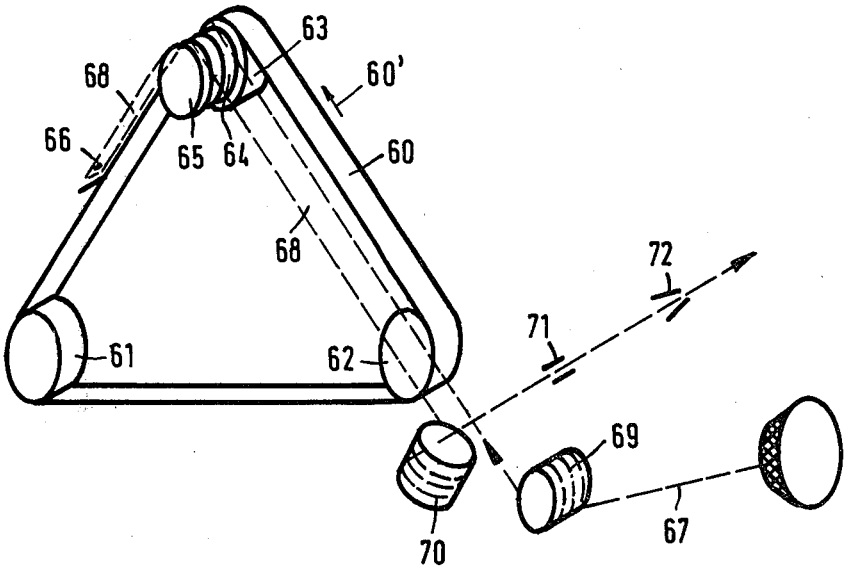

FIG. 3*a* is a plan view looking in the direction of an arrow IIIa in FIG. 3; and FIG. 4 shows a variant of FIG. 3*a;*

Figure 1:
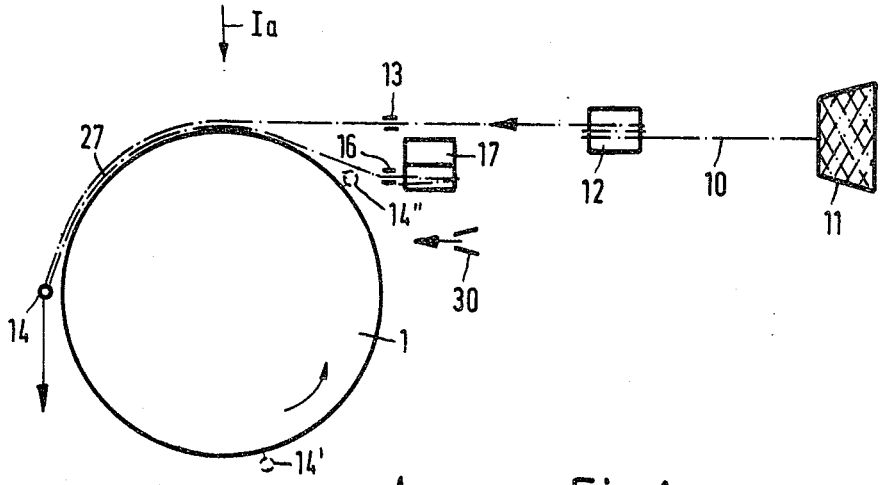
Figure 1A:
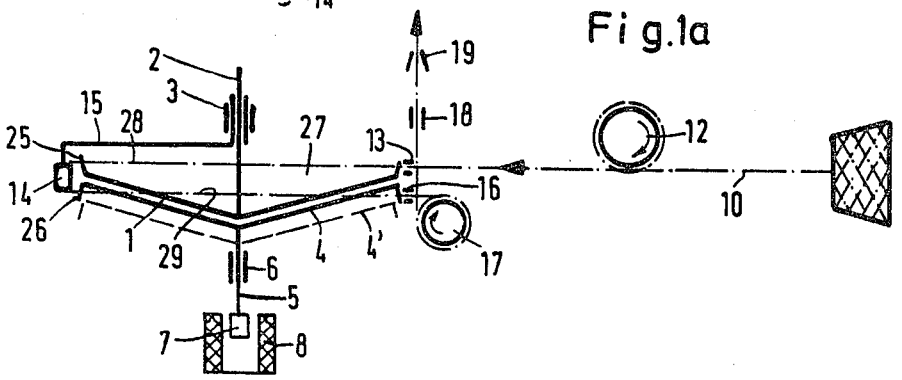

Referring to FIG. 1, the yarn storage device has a yarn carrier formed by a pair of oppositely disposed storage drums 1, 2. One storage drum 1 is mounted on a drive shaft 2 which, in turn, is mounted in a bearing 3 while the other storage drum 4 is mounted on a shaft 5 which, in turn, is mounted for axially movement in a bearing 6. The drum 4 is not rotatable.

An actuating means is provided for moving the shaft 5 axially. As indicated, the actuating means includes e.g. a solenoid arrangement comprising a moving armature 7 and an energizing winding 8. The armature 7 is attracted when the winding 8 is energized, so that the drum 4 is disengaged or separated from the drum 1. A weft yarn 10 of a supply bobbin 11 extends around a feeder drum 12, goes therefrom through a yarn-guiding system in the form of an eye 13, a yarn guide (e.g., a cylindrical eye) 14 of a yarn advancer 15 and an eye 16, then passes around a picking drum 17, then continues on its way to the shed (not shown) by way of yarn brake 18 and a pneumatic picking nozzle 19. The advancer 15, which is in the form of a crank also rotatably mounted in the bearing 3, is so driven by means (not shown) that the eye 14 moves over the periphery of the drums 1, 4. The two drums 1, 4 have a slightly conical shape 25, 26 respectively to facilitate rapid discharge of the yarn 10 at picking. The drum 1 need not rotate and can be stationary.

The device operates as follows:

Prior to picking, the feeder drum 12, which runs at the same speed as the drum 1, draws the yarn 10 off the bobbin 11 for supply to eye 14 of advancer 15. The eye or guide 14, which moves over the periphery of the drums 1, 4 and rotates in the same direction as the drum 1, deposits the weft yarn in a loop 27 on the two drums 1, 4, so that one arm 28 of the loop 27 rests on the drum 1 and the other arm 29 on the drum 4. Once the guide 14 has deposited the required length of yarn to be stored on the drums, e.g. when the guide 14 has reached the position 14', the winding 8 acts to move the drum 4 axially away from the drum 1 and into the position 4'. Consequently, the arm 29 of the loop 27 ceases to be supported by the drum 4 and slips off the same. Simultaneously, the stored length of yarn begins to be picked, the brake 18 being released, the nozzle 19 being supplied with air and the picking drum 17 starting to rotate, so that the arm 29 is picked, followed by the arm 28 which is now drawn off the drum 1. The picking phase lasts from position 14' of yarn guide 14 until position 14'' thereof i.e., less than 180°. The storage phase lasts from position 14'' to position 14' i.e., greater than 180°. During the picking phase yarn is also delivered off the drum 12. Entanglement of the two arms of the yarn loop during picking can be prevented by a nozzle 30 blowing air into the storage area. The guide or eye 14 continues to move around the drum and lays a new loop thereon. Of note, the actuating means for moving the storage drum 4 also serves to release the yarn loop from the drums for removal from storage.

Figure 2:
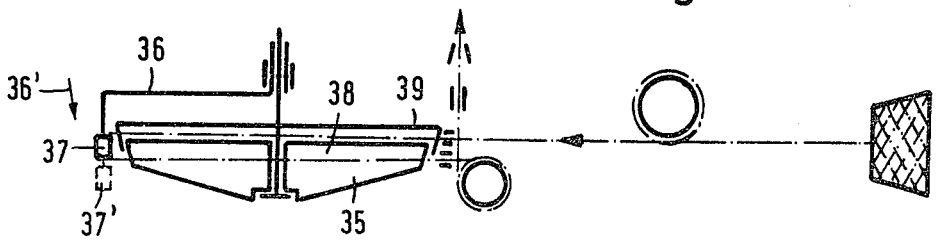
FIG. 2 is a plan view of a variant of FIG. 1.

The yarn storage device shown in FIG. 2 has a drum 35 which, in contrast to the embodiment of FIG. 1, is stationary—i.e., the drum 35 is not movable axially. In this embodiment, the yarn is deposited by a yarn advancer (36) and associated yarn guide 37 which, as well as rotating, can be moved axially by means which are not shown. Immediately before picking, the advancer 36 is pressed in the direction indicated by an arrow 36' so that the guide or eye 37 moves into the position 37' and the two arms of the loop 38 slip off the drums 35, 39 and disengage therefrom. In this case, therefore, the yarn is removed outside the drums and not therebetween.

The yarn storage device shown in FIG. 3 comprises a yarn advancer in the form of an endless belt 40. The two drums 1 and 4 of FIG. 1 are replaced in this case by two diagrammatically illustrated discs or pulleys or the like 41, 42. The belt 40 runs over two pulleys or discs or the like 43, 44, one of which is driven by the weaving machine. Disc 41 can be connected to disc 44 and therefore driven thereby or the disc 41 can be driven independently. The disc 42 does not rotate. The belt 40 has a yarn eye or guide 45 (shown diagrammatically) to guide a weft yarn 46. The weft yarn 46 runs off a supply bobbin 47, around a feeder drum 48 and then through the yarn guide 45, then goes to a picking drum 49 and by way of a brake 50 and picking nozzle 51 to the shed. Consequently, when the belt 40 moves in the direction indicated by an arrow 40', a loop 52 arises in the yarn, one arm of the loop 52 being disposed on the drum 41 and the other on the drum 42, as described with reference to FIG. 1. Just before picking, the drum 42 disengages from the drum 41 so that the loop 52 can disengage and be picked into the shed.

The yarn advancer of the device shown in FIG. 4 is also an endless belt but runs on a triangular path. A belt 60 runs around three rollers 61–63 which are arranged in a triangular array, one of which is driven. Discs 64, 65, shown in diagrammatic form, are used instead of the drums 1, 4 respectively of FIG. 1. Belt 60 has a yarn guide or eye 66 which forms a loop 68 in a weft yarn 67. As the belt 60 moves in the direction indicated by an arrow 60' and as a feeder drum 69 rotates, the loop 68 is laid around the discs 64, 65 in the manner described with reference to FIG. 3. Picking proceeds just as in FIG. 3, through the agency of a picking drum 70, brake 71 and picking nozzle 72.

In order that a yarn carrier for a relatively large weaving width may be of relatively reduced diameter, the weft yarn can be deposited on the yarn carrier. In more than one loop; in this case, the yarn carrier 110 of FIG. 1 can be formed on the periphery 111 with a helical groove 112. During rotation, the yarn advancer 113 forms from the weft yarn 114 on the yarn carrier a coil 115 having a number of loops 116, the number being determined by the number of revolutions of the yarn advancer 113. The groove flanks on the side of an orifice 117 of the advancer 113 prevent the loop from sliding forwards axially during winding-on. Just before the winding 115 starts to be removed from storage—i.e., before the weft yarn starts to be picked—the electromagnet 119 is de-energized so that armature 120 is disengaged from yarn carrier 110 by spring force and releases the weft yarn. The brake 121 releases simultaneously so that the weft yarn 114 is drawn by picking nozzle 122 out of the groove 112 and into the shed.

In the embodiment shown in FIG. 9, to facilitate the drawing of the yarn out of the groove, a conical portion 127 of a yarn carrier 128 is formed with a helical groove 125 to receive a winding or coil 126. In other respects the device corresponds to the device shown in FIG. 7.

The subject matter of the invention has been described in relation to a weaving machine with air picking, but it is of use for other weaving machines, e.g. for a gripper projectile weaving machine.

We claim:

1. A weft yarn storage device for a weaving machine comprising a pair of storage drums;

a yarn advancer having a yarn guide disposed for rotation about said drums to lay one arm of a yarn loop on one of said drums and another arm of the yarn loop on the other of said drums; and actuating means for causing a relative position of said yarn guide and at least one of said drums for releasing the yarn loop from said drums for insertion into a shed.

2. A weft yarn storage device as set forth in claim 1 wherein one of said drums and said yarn advancer are rotatable in the same direction, said other drum is stationery and said actuating means is connected to said other drum to separate said drums from each other to release the yarn loop therebetween.

3. A weft yarn storage device as set forth in claim 1 wherein one of said drums and said yarn advance are rotatable in the same direction, said other drum is stationery and said actuating means is connected to said yarn advancer to move said yarn advancer coaxially of said drums to release the yarn loop from said drums.

4. A weft yarn storage device as set forth in claim 1 wherein said yarn advancer is a rotatable crank.

5. A weft yarn storage device as set forth in claim 1 wherein said yarn advancer is an endless belt.

6. A weft yarn storage device as set forth in claim 5 wherein said endless belt extends around three guide rolls arranged in a triangular array.

7. A weft yarn storage device as set forth in claim 1 wherein said actuating means includes an electromagnet having an armature movable from a yarn holding position into a yarn release position.

8. A weft yarn storage device as set forth in claim 7 wherein said yarn advancer is continuously rotatable.

9. A weft yarn storage device for a weaving machine comprising a yarn carrier having a pair of coaxial storage drums each having a peripherally curved surface;

a yarn advancer having a yarn guide for directing yarn onto and about at least a part of said curved surface of each said drum to define at least one loop of yarn thereon; and actuating means for moving at least one of said drums or said yarn guide coaxially relative to each other for releasing the yarn loop from said drums for removal from storage.

* * * * *

UNITED STATES PATENT AND TRADEMARK OFFICE

CERTIFICATE OF CORRECTION

PATENT NO. : 4,403,634

DATED : September 13, 1983

INVENTOR(S) : Frantisek Jankovsky and Paul Lincke

It is certified that error appears in the above—identified patent and that said Letters Patent is hereby corrected as shown below:

Columns 3 and 4, lines 56-13, delete "In order...Fig. 7"

Signed and Sealed this

*Twenty-fourth* Day of *January 1984*

[SEAL]

*Attest:*

GERALD J. MOSSINGHOFF

*Attesting Officer*

*Commissioner of Patents and Trademarks*